United States Patent [19]

Mayer

[11] 4,197,883

[45] Apr. 15, 1980

[54] SECONDARY FUEL RECOVERY SYSTEM

[75] Inventor: Edward A. Mayer, Newburgh, N.Y.

[73] Assignee: Texaco Inc., White Plains, N.Y.

[21] Appl. No.: 869,747

[22] Filed: Jan. 16, 1978

[51] Int. Cl.[2] ..... B65B 3/18

[52] U.S. Cl. ..... 141/59; 137/565; 141/96; 141/290; 141/302

[58] Field of Search ..... 137/565; 141/59, 93, 141/94–96, 214, 215, 225, 226, 290, 301, 302, 392

[56] References Cited

U.S. PATENT DOCUMENTS

| | | | |
|---|---|---|---|
| 3,874,427 | 4/1975 | Tiggelbeck | 141/290 X |
| 3,974,865 | 8/1976 | Fenton et al. | 141/226 X |
| 4,031,930 | 6/1977 | Sutcliff et al. | 141/226 X |
| 4,057,085 | 11/1977 | Shihabi | 141/290 X |
| 4,072,934 | 2/1978 | Hiller et al. | 141/290 X |

*Primary Examiner*—Frederick R. Schmidt

*Attorney, Agent, or Firm*—Thomas H. Whaley; Carl G. Ries; Robert B. Burns

[57] ABSTRACT

A fuel system in which a fuel dispensing nozzle removably and sealably engages a fuel tank. Pressure sensing means in the nozzle monitors the degree of vacuum established adjacent to the nozzle seal, and in response thereto, actuates a vacuum control apparatus. The latter then functions by regulating the volume of vapor flow withdrawn from the fuel tank, to maintain a desired degree of vacuum adjacent to said seal whereby to avoid or minimize the intake of air into the fuel system.

3 Claims, 4 Drawing Figures

SECONDARY FUEL RECOVERY SYSTEM

BACKGROUND OF THE INVENTION

To avoid the possible undesirable effects of volatile vapors entering the atmosphere during a fuel tank filling operation, a number of liquid or fuel systems have been devised. One of such systems, identified broadly as a balanced fuel system, embodies the principle of liquid fuel, and vapor simultaneously flowing between the storage reservoir and a tank being filled. Thus, as liquid is introduced into the fuel tank, vapors comprising both air and fuel vapors are concurrently displaced. The latter are then led back to the storage reservoir or to an alternate vapor holding means.

Since the amount of liquid introduced to the receiving fuel tank is not always equivalent to the amount of vapor which is removed, it is difficult to maintain such a system in a balanced or stabilized condition. More particularly, a number of factors will contribute to the ratio of the vapor to liquid flow which characterizes the condition of the system at any period of time. Such factors include the temperature of the atmosphere about the tank being filled, and the conditions within the reservoir or storage vessel.

To make such a system workable, means is generally provided to avoid an excessive build-up of pressure. Alternately, and to the contrary, it is desirable to avoid the inhalation of excessive amounts of air into the system which would be necessary to achieve the proper system balance.

The intake of any air into the system is of course undesirable since the air mixes with fuel vapors present in the storage reservoir. The combination can, if continued, contribute to a relatively unsafe atmosphere.

While such balanced systems are normally vented to the atmosphere as an expedient toward maintaining their balanced condition, it is found that the amount of air ingested into the system can be minimized. This is possible if the conditions at the nozzle-fuel tank sealed joint can be maintained in such a condition as to avoid the intake of air at the seal face.

Preferably, the pressure at this point in the system is maintained slightly below atmospheric such that in the event the seal is not completely made, the amount of air ingested will be minimal. This will be due to the slight pressure difference between the internal and external conditions about the seal.

In any balanced system that is satisfactory, particularly for widespread commercial use, the instant invention is addressed to the concept of stabilizing the condition at a desired pressure, or vacuum level, immediately adjacent to the nozzle seal. The desired function is achieved primarily through the facility of continuous monitoring of the condition at said point during a liquid transfer operation. Thereafter, the condition is adjusted or maintained within a desired parameter of values. The latter step is achieved by control of the pressure in the seal area through use of a vapor inductor in the vapor evacuation line or conduit.

It is therefore an object of the invention to provide a relatively safe, balanced system adapted to carry a volatile liquid or fuel. A further object is to provide a secondary control system adapted to limit and regulate the amount of air which might enter the system in order to achieve the desired balanced condition. A still further object is to provide a volatile fuel system which is adapted to control the balance of air and fuel vapor transferred during a fueling operation in order to minimize the amount of air which is aspirated into the system by way of the nozzle seal.

While the disclosed system is adapted to handle any form of vaporizable liquid, to illustrate the features of the invention, said liquid will be hereinafter referred to as a liquid fuel such as gasoline or the like.

Figure 1:
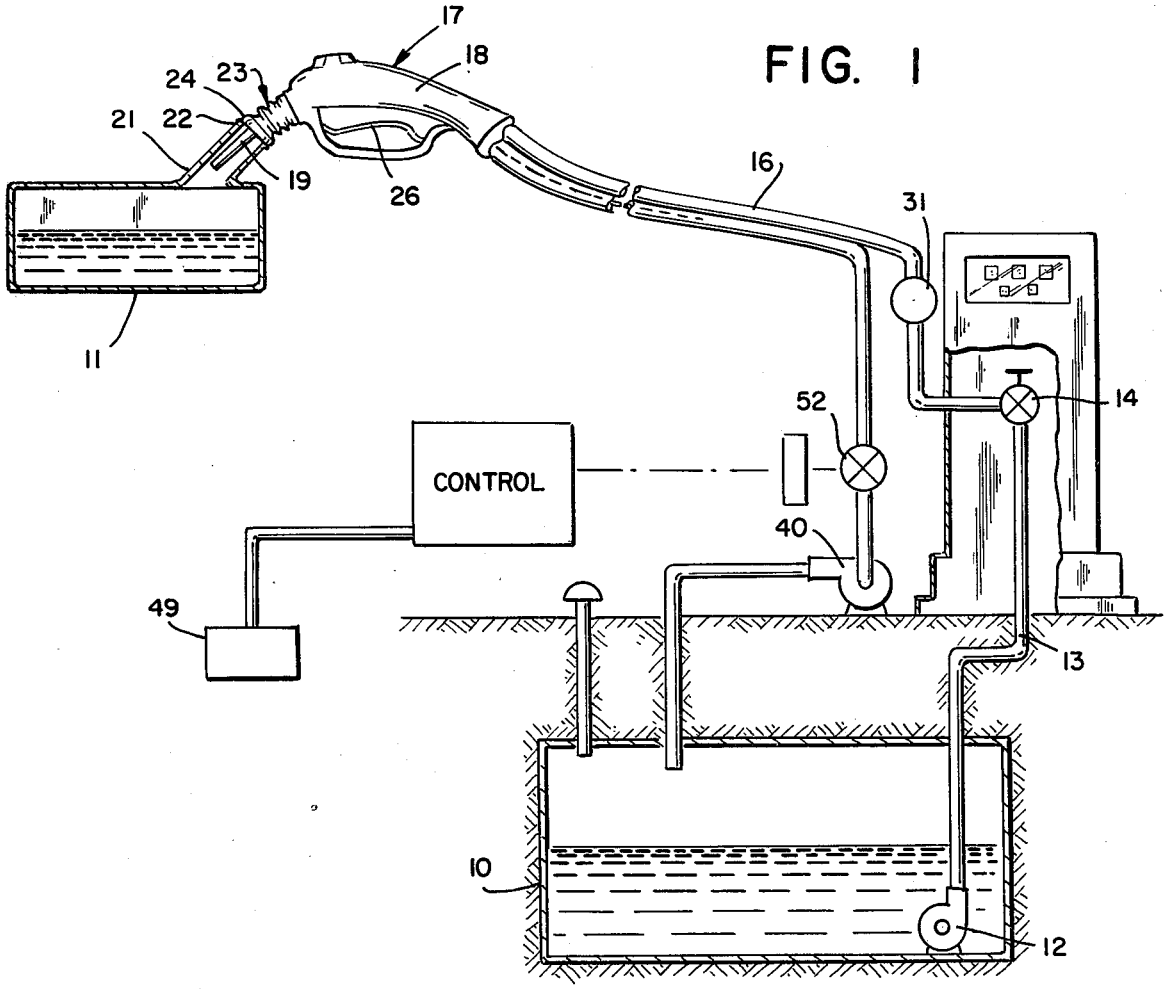
FIG. 1 is a vertical elevation illustrating a balanced system of the type contemplated.

In a balanced fuel system of the type contemplated, and as shown generally in FIG. 1, a reservoir 10 of a vaporizable fuel such as gasoline, is transferred to a tank 11 usually that of an automobile, plane, boat or the like. Reservoir 10 is normally as shown, buried or at least partially buried in the earth to be out of the way and to maintain the fuel supply in a relatively safe, stable condition.

Reservoir 10 is provided with a pump 12 which is operable form a control member 31 at the surface, which functions to activate pump 12 whereby to regulate the flow of fuel which passes from reservoir 10. Thus, a pipe or conduit 13 extending from the pump 12, passes through valve means 14 which can include a register or similar read our device to measure the rate or amount of fuel passing therethrough.

Figure 2:
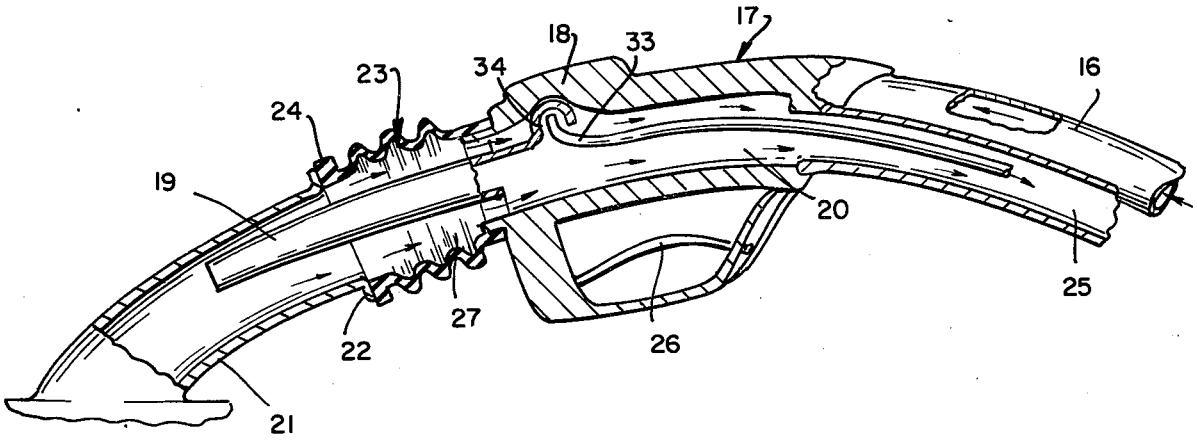
FIG. 2 is a cross sectional illustration of a dispensing nozzle used in the system.
Figure 4:
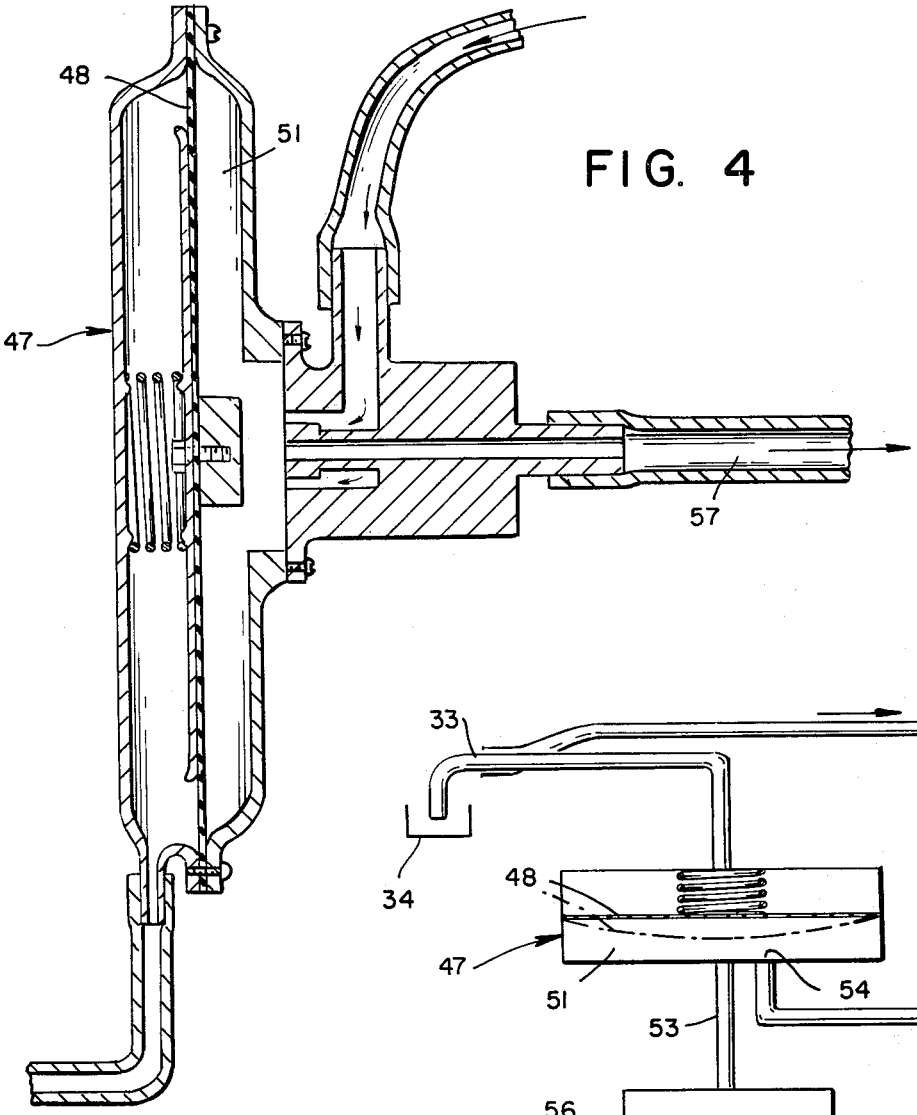
FIG. 4 is an enlarged view in cross section of a portion of FIG. 3.

Flexible conduit 16 extends from the switching means 14, and is sufficiently long to conveniently reach an automobile tank. Said conduit 16 terminates in a manually operated fuel dispensing nozzle 17, which, as shown in FIG. 2, includes primarily a body 18 having a spout 19 depending therefrom.

Operationally, spout 19 is connected into nozzle body 18, which in turn includes appropriate valving to permit manual regulation of the flow of liquid fuel from conduit 16 through the nozzle 17, and into tank 11. Body 18 includes, as mentioned, internal valving, not presently shown in detail, but which is manually adjusted to open condition to initiate fuel flow, and which automatically operates to discontinue said flow upon filling of tank 11. Body 18 further includes passage means for conducting liquid fuel, as well as passage means 20 for returning fuel vapors and air from tank 11.

Tank 11 is normally embodied in a movable vehicle such as an automobile, boat or the like. Said tank thus includes a filler pipe 21 which extends upwardly therefrom terminating at an outwardly projecting rim 22.

To form the desired substantially vapor tight seal between removable dispensing nozzle 17 and tank 11, nozzle 17 is provided with a resilient walled boot 23 or the like.

As shown in FIG. 2, said resilient walled boot 23 includes basically a tubular member which is sealably engaged at one end to the nozzle body 18. The other or open end of said cylindrical member includes a sealing lip 24 which is adapted to tightly engage corresponding lip 2 at the filler pipe 21 upper end. Thus, when the nozzle 17 is fully inserted into filler pipe 21, boot 23 will be deformed and a peripheral vapor tight seal will be established between the resilient lip 24 and the upper rim 22 of filler pipe 21.

It is at this point of temporary engagement that the greatest possibility exists of there being an inefficient or discontinuous vapor seal between nozzle and filler pipe, with the consequence that air will tend to leak into the fuel system. During a normal filling operation of tank 11, fuel from flexible, dual conduit conductor 16 flows through the nozzle 17 in response to movement of the main valve actuating lever 26.

Thereafter, fuel vapors and air, which are forced upwardly through tank 11, are conducted through filler pipe 21. They pass thence into the annular chamber 27 defined by the nozzle spout 19 and the resilient boot 23. Said air and fuel vapors are then conducted by way of nozzle 17, through a separate conduit 25, to be deposited in fuel holding reservoir 10.

To maintain the integrity of the balanced system with respect to the influx of air, pressure sensing means are provided in nozzle 17, preferably at a point as close as possible to the provisional seal formed between boot 23, and filler tube 21. This pressure sensing means is designed to continuously monitor pressure or vacuum at the seal. Further, it initiates operation of vapor conducting pump or inductor means 40, having the purpose of assuring that the degree of the pressure or vacuum at the seal will be maintained substantially constant, or within an acceptable range of values slightly below atmospheric.

As shown in FIG. 2, the pressure or vacuum sensing feature embodied in nozzle 17 comprises an elongated tube 33. An open end of the tube is disposed within the nozzle passageway along which vapors will normally flow after tank 11. The tube open or sensing end is preferably provided with a protection cap 34 or similar partial closure member. The latter is positioned in a manner to avoid entry of liquid into tube 33 and yet not interfere with the accurate sensing of vapor pressure along the vapor passage.

The degree of, or acceptable range, of the vacuum maintained at the sealed interface of boot 23 and filler tube 21 is relevant to proper operation of the disclosed dispensing system. Thus, the sensing or monitoring of the internal conditions at the seal by way of tube 33, is continuous so long as liquid fuel is flowing through the system.

Further, to discriminate between small variations that go beyond the acceptable pressure range, the system response and control means are both relatively sensitive and quick acting.

In a preferred embodiment of the control system the latter as a whole is activated by the flow of liquid through an element such as by control member 31. Thereafter, as vapor is urged from tank 11 and through nozzle 17, a signal is sent from tube 33 into the system's control circuit in response to the amount of vapor flow.

Within said control circuit the weak signal is received and amplified to a magnitude such that it is capable of regulating operation of the vapor induction member 40, or the disposition of vapor flow valve 52 which controls the flow of vapor which will enter the inductor 40.

In the instant arrangement a source of air or other gas is utilized as the medium for achieving signal amplification whereby to regulate the flow of vapor.

Thus, during the filling operation of tank 11, tube 3 will continuously register a condition, whether the latter be variable or constant. This condition will be responsive to the pressure immediately upstream of the nozzle sealed area.

Said pressure during a fuel flow will normally vary depending on the efficiency of the temporary sealed engagement between nozzle 17 and the tank filler pipe 21. The pressure will, however, also be responsive to the volume of vapor which moves past the sensing point at the open end of tube 33. Thus, instantaneous and sporadic operation of the vapor flow control circuit will characterize the usual functioning of the system.

Figure 3:
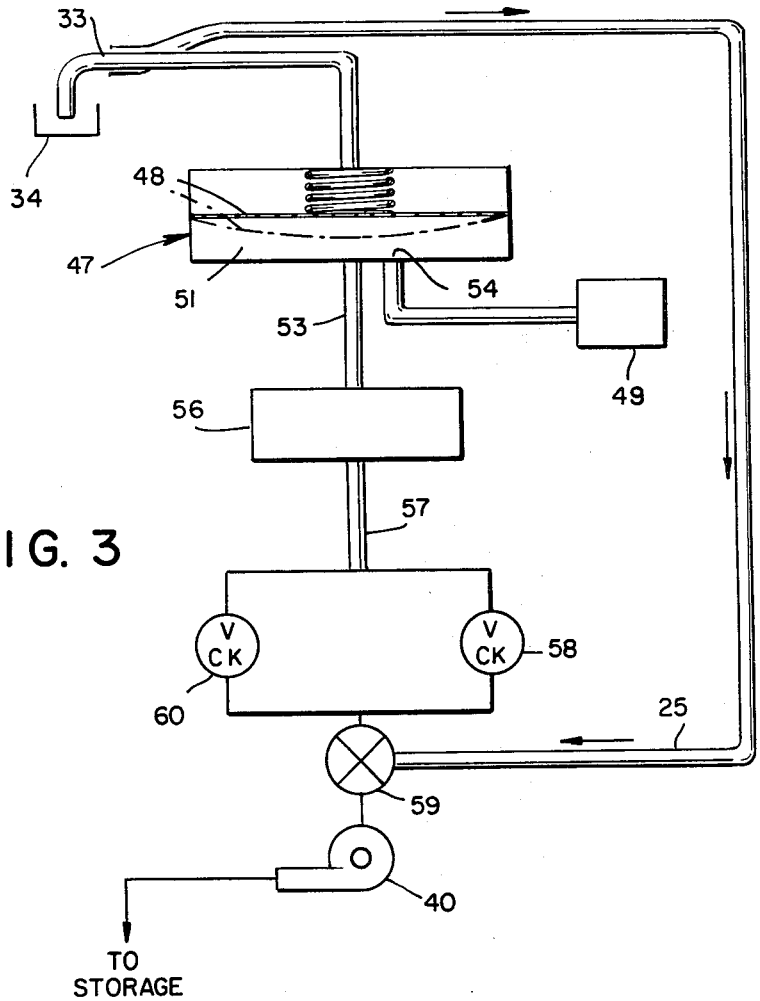
FIG. 3 is a schematic arrangement of the system illustrating the various lines and connections.

In one embodiment of the control arrangement to achieve the desired sensitivity and rapidity of response, and as shown in FIG. 3, a weak signal in the form of a sensed pressure is transmitted to proximity controller 47 whereby to act on one side of a pressure sensitive diaphragm 48. Said controller 47 is further communicated with a source of air 49. Thus, air will be conducted into chamber 51 and thence into line 53, only at such time as diaphragm 48 is subjected to a higher pressure and displacement whereby to move closer from seat 54.

The air flow in line 53 is then conducted to fluid amplifier 56 wherein as noted, the pressure is amplified. Said amplifier can assume any one of a number of commercial embodiments on the market adapted to modify a gaseous pressure. The air stream is thereafter conducted by way of line 57 into a network comprising check valves 58 and orifice 59.

From the latter, the now modified and usable air pressure is transmitted to a valve actuator operably connected to valve 52 to cause the latter to close. This action will act to discontinue vapor flow from vapor line 25, into inductor 40 and thence into reservoir 10.

As back pressure in line 25 reduces, it will be sensed in nozzle 17 by sensing tube 33. The signal indicating overall pressure is now transmitted to controller 47. Said signal when directed through the control circuit to valve 52 actuator, will cause valve 52 to close and flow through inductor 40 will be reduced.

The sequence of periodically adjusting vapor flow through line 25 will thereafter continue in response to the monitoring action of tube 33 such that the overall pressure condition in the vapor line will be stabilized at the desired level.

Other modifications and variations of the invention as hereinbefore set forth can be made without departing from the spirit and scope thereof, and therefore, only such limitations should be imposed as are indicated in the appended claims.

I claim:

1. In a balanced system for handling and dispensing a volatile liquid, which system includes a storage reservoir holding a supply of the volatile liquid to be dispensed, a first elongated conduit means (13–16) communicated at one end with said liquid supply, and having a dispensing nozzle (17) at the conduit other end, said dispensing nozzle (17) being adapted to releasably engage the filler pipe of a liquid receiving tank (11) in a fluid tight sealed connection (24), and a second conduit means (25) communicated with said dispensing nozzle (17) to receive a flow of vapor which is displaced from said receiving tank by inflowing liquid, and pressure sensing means (33, 34) disposed in said dispensing nozzle (17) to monitor the pressure level maintained at said connection (24), the improvement in said system of;

a vapor inductor means (40) having inlet and discharge ports respectively, the latter being communicated with said storage reservoir (10), valve means (52) communicated with said second conduit means and with said inductor inlet and including actuating means responsive to a signal delivered thereto for actuating said valve means (52) between open and closed positions whereby to regulate the flow of vapor which passes to said inductor (40) inlet, pressure amplifying means including a fluid control means (47) communicated with a source of pressurized gas (49), and with said pressure sensing means (33, 34) respectively, to provide an actuating signal in response to a pressure differential detected by said pressure sensing means (33), conductor means (57) communicating said valve (52) actuating means with said pressure amplifying means whereby said valve (52) will be actuated to an open position thereby allowing vapor to pass therethrough, in response to a predetermined pressure level at said dispensing nozzle connection to said filler pipe.

2. In a system as defined in claim 1 including check valve means (58–60) disposed in said conductor means (57) to regulate the flfow of compressed gas which passes through said valve (52) actuator.

3. In a system as defined in claim 1 wherein said source of pressurized gas is compressed air.

* * * * *